US011192693B2

(12) United States Patent
Schnaars

(10) Patent No.: US 11,192,693 B2
(45) **Date of Patent: *Dec. 7, 2021**

(54) BULK BAG HAVING A MULTI-SIDED SHAPED BOTTOM

(71) Applicant: AMERIGLOBE, LLC, Lafayette, LA (US)

(72) Inventor: Daniel R. Schnaars, Lafayette, LA (US)

(73) Assignee: AMERIGLOBE, LLC, Lafayette, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/805,236

(22) Filed: Feb. 28, 2020

(65) Prior Publication Data

US 2020/0262613 A1 Aug. 20, 2020

Related U.S. Application Data

(63) Continuation of application No. 15/876,981, filed on Jan. 22, 2018, now Pat. No. 10,577,155, which is a (Continued)

(51) Int. Cl.
*B65D 33/00* (2006.01)
*B65D 30/00* (2006.01)
(Continued)

(52) U.S. Cl.
CPC ..... *B65D 29/00* (2013.01); *B65D 33/00* (2013.01); *B65D 88/1612* (2013.01); *D05B 13/00* (2013.01)

(58) Field of Classification Search
CPC ..... B65D 29/00; B65D 33/00; B65D 88/1612
(Continued)

(56) References Cited

U.S. PATENT DOCUMENTS 164,389 A 6/1875 Mill
426,842 A 4/1890 Mortson
(Continued)

FOREIGN PATENT DOCUMENTS

DE 4328365 3/1995
WO WO0029310 5/2000

OTHER PUBLICATIONS

International Search Report and Written Opinion for PCT International Patent Application No. PCT/US2010/043084 (dated Mar. 4, 2011).

*Primary Examiner* — Peter N Helvey
(74) *Attorney, Agent, or Firm* — Garvey, Smith & Nehrbass, Patent Attorneys, L.L.C.; Julia M. FitzPatrick; Gregory C. Smith

(57) ABSTRACT

A fabric bulk bag and a method for constructing the same, the bag including a continuous sidewall, a top portion, and a bottom, all defining a bulk storage space therein; the bottom further comprising eight sides which define an octagonal shape having an enlarged footprint so that the bag wall is sewn to the bottom in less time than a round shaped bag, yet when filled stands more upright with less tendency to lean than the current square shaped bags thereby providing a safer more dependable stacking bulk bag. In the method of producing the fabric bulk bag, the bag is constructed in less time than the prior art round bottom bags, uses less wall fabric than prior art square bottomed bags and when constructed and filled, supports itself more stable on a floor or pallet because it provides substantially more base for the product to rest on. In other embodiments, the bag would be multi-sided with greater than four sides.

19 Claims, 12 Drawing Sheets

Related U.S. Application Data continuation of application No. 14/156,180, filed on Jan. 15, 2014, now Pat. No. 9,873,552, which is a continuation of application No. 12/842,601, filed on Jul. 23, 2010, now Pat. No. 8,646,973.

(60) Provisional application No. 61/234,449, filed on Aug. 17, 2009.

(51) Int. Cl.
*B65D 88/16* (2006.01)
*D05B 13/00* (2006.01)

(58) Field of Classification Search
USPC ..... 383/104
See application file for complete search history.

(56) References Cited

U.S. PATENT DOCUMENTS

| | | | |
|---|---|---|---|
| 1,015,007 | A | 1/1912 | Cutler |
| 1,163,545 | A | 12/1915 | Kennedy |
| 1,909,102 | A | 5/1933 | Greene |
| 1,951,011 | A | 3/1934 | Falk |
| 1,976,687 | A | 10/1934 | Butterfield |
| 2,432,122 | A | 12/1947 | Pardee |
| 2,673,024 | A | 3/1954 | Kuss |
| 3,430,841 | A | 3/1969 | Kanaga |
| 3,957,179 | A | 5/1976 | Bamburg et al. |
| 4,850,506 | A | 7/1989 | Heaps, Jr. et al. |
| 5,178,275 | A | 1/1993 | Fitzgerald et al. |
| 5,328,268 | A | 7/1994 | LaFleur |
| 5,649,767 | A | 7/1997 | Nickell et al. |
| 5,885,002 | A | 3/1999 | Reiss |
| 5,893,644 | A | 4/1999 | Derby |
| 5,897,211 | A | 4/1999 | Hafer et al. |
| 5,899,337 | A | 5/1999 | Thebeault |
| 6,000,549 | A | 12/1999 | Perkins |
| 6,004,035 | A | 12/1999 | Hafer et al. |
| 6,015,057 | A | 1/2000 | Stone et al. |
| 6,109,786 | A | 8/2000 | Hafer et al. |
| 6,244,443 | B1 | 6/2001 | Nickell et al. |
| 6,287,003 | B1 | 9/2001 | Hafer |
| 6,394,277 | B2 | 5/2002 | Nickell et al. |
| 6,415,927 | B1 | 7/2002 | Stone et al. |
| 6,416,222 | B2 | 7/2002 | Hafer |
| 6,491,434 | B2 | 12/2002 | Hafer |
| D476,814 | S | 7/2003 | Thorpe |
| 6,688,471 | B2 | 2/2004 | Stone et al. |
| 6,935,508 | B2 | 8/2005 | Stone et al. |
| 7,604,156 | B2 | 10/2009 | Clohessy |
| 8,646,973 | B2 | 2/2014 | Schnaars |
| 9,873,552 | B2 | 1/2018 | Schnaars |
| 10,577,155 | B2 | 3/2020 | Schnaars |
| 2001/0038720 | A1 | 11/2001 | Hafer |
| 2002/0008517 | A1 | 1/2002 | Derby et al. |
| 2005/0196080 | A1 | 9/2005 | Stone et al. |

(SIDE VIEW)

(BOTTOM VIEW)

(BOTTOM VIEW)

BULK BAG HAVING A MULTI-SIDED SHAPED BOTTOM

CROSS-REFERENCE TO RELATED APPLICATIONS

This is a continuation of U.S. patent application Ser. No. 15/876,981, filed 22 Jan. 2018 (issued as U.S. Pat. No. 10,577,155 on 3 Mar. 2020), which is a continuation of U.S. patent application Ser. No. 14/156,180, filed 15 Jan. 2014 (issued as U.S. Pat. No. 9,873,552 on 23 Jan. 2018), which is a continuation of U.S. patent application Ser. No. 12/842,601, filed 23 Jul. 2010 (issued as U.S. Pat. No. 8,646,973 on 11 Feb. 2014), which is a non-provisional patent application of U.S. Provisional Patent Application Ser. No. 61/234,449, filed 17 Aug. 2009, each of which is hereby incorporated herein by reference.

Priority of and/or the benefit of U.S. patent application Ser. No. 15/876,981, filed 22 Jan. 2018; U.S. patent application Ser. No. 14/156,180, filed 15 Jan. 2014; U.S. patent application Ser. No. 12/842,601, filed 23 Jul. 2010, and U.S. Provisional Patent Application Ser. No. 61/234,449, filed 17 Aug. 2009, which are incorporated herein by reference, is hereby claimed.

International Application No. PCT/US2010/043084, filed 23 Jul. 2010 (published as WO2011/022169 on 24 Feb. 2011), is hereby incorporated herein by reference. ASSIGNEE: AMERIGLOBE, LLC, a U.S. limited liability company created and existing under the laws of the state of Oklahoma, having an address of 153 South Long Street, Lafayette, La. 70506, US.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to fabric bulk bags. More particularly, the present invention relates to a novel bulk bag configuration wherein the bottom of the bag has an octagonal or other multi-sided shape which, when filled with product, is fully supported by the pallet without the bag needing to shift and lean. As a result, the side walls stay naturally in position. This bag is more attractive and much safer to stack upon.

2. General Background of the Invention

In the art of making bulk bags, the historical designs have all been created from the point of view of manufacturing efficiency. The goals have been to eliminate waste and reduce manpower.

Hence, almost all bulk bags have been made with square or rectangular bottoms with vertical walls rising up from the four sides. A good example of this would be the original designs of Peter Nattrass, one of the early inventors of the bulk bag concept.

This concept eliminates any lost fabric and makes production quite efficient with straight sewing lines in all major seams.

However, in usage, a bulk bag is simply a box shaped flexible fabric container. As loose product is poured into the bag, it applies equal pressure in all directions. Uncontained loose product when poured onto the ground forms a cone with a circular shaped bottom. When this natural action is applied to product entering into a fabric bag, the natural forces attempt to change the bag into a cylinder.

In the lower portions of the bag, this cannot occur as the fabric that is directly attached to the square bottom is held to that configuration. But the further up the vertical walls of the bag from the bottom, the less control the bottom square has over the side wall fabric. Within the first 10 inches (25 cm) of the vertical sidewalls above the bottom square panel, the shape of the bag becomes cylindrical. The constraints of the square bottom no longer applies. The flexible bag forms a nearly perfect cylinder in the central portions of the filled bulk bag.

The perimeter of the bag becomes the circumference of the cylinder. Bulk bags come in a variety of sizes. The most common are 34 inches (86 cm) square, 35 inches (89 cm) square, 36 inches (91 cm) square, 37 inches (94 cm) square and 38 inches (97 cm) square.

For purposes of discussion we will use the 37 inch (94 cm) square bag for all the following discussions but it is clear that this new design can be applied to all sizes of bags by using the same thought processes described below.

A bulk bag that is made 37 inches by 37 inches (94 cm by 94 cm) square has a perimeter of 37 inches (94 cm) times 4, or 148 inches (376 cm). A cylinder with a 148 inch (376 cm) perimeter has a diameter of 148/Pii (3.1416) or 47.1 inches (120 cm) in diameter.

Therefore a filled bulk bag that started out as a 37 inch (94 cm) square bag has a square bottom of 37×37 inches (94 cm×94 cm) and an area of 1369 square inches (8832 square cm). Approximately 7 to 8 inches (18 to 20 cm) above the floor the bag has rounded out to a cylinder with a diameter of 47.1 inches (120 cm) and a cross sectional area of 1742 square inches (11,238 square cm).

The resulting cylinder has an area that is greater than the base by 27.2%. This then leads to the conclusion that approximately 25% of the product within each standard bulk bag design is initially unsupported by the pallet or floor. This means that each side of the square bottom bag has unsupported columns of product that are greater than 6% of the total product.

Since the bag has no supporting structure, the loose product outside the support area of the floor or pallet will shift downward during the vibration of handling.

This movement will continue until the great majority of the product within the bag has reached a supported position.

Since the diameter in this case is 10 inches (25 cm) larger than the cross section of the base, the only way for the product to reach support is to convert a portion of the bag sidewall into a floor. In other words, 5 inches (13 cm) of sidewall will be laid flat to gain the support for the product in the 25% of unsupported cylinder that was described above.

If this happens evenly all around the bag, then the bag simply becomes approximately 5 inches (13 cm) shorter with a cylindrical shape from the floor or pallet to the top of the product area.

However, with any inertia such as happens with transport, the product settles to the floor more quickly in one direction versus the other directions. In this case, the product will lay more than 5 inches (13 cm) horizontally to that one side to reach support. This natural action then results in causing the bag to lean in that same direction. One side is longer than the opposite side so the bag is forced to lean toward the newly shortened side.

This is the basic cause of the instability that most bulk bags exhibit when being shipped or being stacked.

The only known exceptions to this are bulk bag designs called baffle bags and some bulk bags that are made with a fully circular bottom. In the case of baffled design bags, the main body of the bag has interior walls that prevent the bag from reshaping itself into a cylinder. While this is an option, it is a fairly expensive option that requires extra fabrics and extra sewing seams. Further, it separates the interior of the bag into 5 separate chambers. The baffle bag essentially tries to overcome the natural forces of gravity by force.

The proposed invention in this patent is attempting to work with the natural forces by providing a more natural rounding to the bag base.

The other known prior art are bags that have a circular bottom, for example, from Japan. While this bag is very stable, it is difficult to place on a square pallet. It has no straight sides to help the operator line up the edges. Further, the 47 inch (119 cm) diameter bag would have to be on a minimum 47 inch (119 cm) square pallet for full support. Since export containers are only 92 inches (234 cm) wide, 2 pallets of this side cannot fit into the containers side by side. Therefore, the bag will have areas of non-support that droop down over the edge of the necessarily smaller pallet and be vulnerable to damage. The invention proposed here eliminates this particular issue with the fully circular bottom bag.

However, after 30 years of International recognition, this design has not moved successfully into the rest of the world. This has been primarily because of the expense and difficulty of producing this design.

In producing the same bag spoken about above, the perfect circle of 47.1 inch (120 cm) would have to be created from a minimum of a 51 inch (130 cm) square piece of fabric. The bottom panel on a bulk bag is a supporting panel and thus generally involves at least one fold of fabric to create two layers at all points of the seam. This means that the bottom requires a piece of fabric with an area of 2,601 square inches (16,781 square cm).

The bottom for the same bag in standard square design is made from 42×42 inches (107×107 cm) fabric with an area of 1764 square inches (11,381 square cm) of fabric. Therefore, the circular bottom requires 47% more fabric than the bottom of the square bag.

In a production situation, the sewing machines used in this industry are designed for straight line sewing. It is quite difficult for this type of machine to apply a seam in a circular manner. The operator must sew only an inch or two (3 to 5 cm) then stop and turn the fabric slightly. This happens approximately 74 times on this type of bag. This number of stops makes the cost of labor go up and the speed of production goes down.

Therefore, there is a need in the industry to provide a bag which will be stable when filled, yet which will be easy to construct without creating wasted fabric or slows down production, as does round bags. The present invention, which is a bag having an octagonal bottom, solves those problems. By going to an octagonal bottom, we speed up the sewing, reduce the waste, fit pallets and provide an appearance that is not square but also not round, which provides a larger footprint when the bag is filled to avoid the side walls of the bag from making contact with the surface upon which the bag rests and causing the filled bag to sag and being unable to support filled bags stacked on top of it.

BRIEF SUMMARY OF THE INVENTION

The present invention solves the problems in the art in a simple and straightforward manner. What is provided is a fabric bulk bag and a method of constructing same, the bag including a continuous sidewall, which may or may not be constructed of panels of fabric sewn edge to edge to define the continuous sidewall, a top portion, and a bottom, all defining a bulk storage place therein; the bottom further comprising multiple sides, preferably eight sides, which define an octagonal shape, so that the bag wall is sewn to the bottom in less time than a round shape bag, and when filled the bag stands more upright to support other filled bags thereupon. In the method of producing the fabric bulk bag, the bag is constructed in less time than prior art round bags, uses less wall fabric than prior art square bags, and when constructed and filled, supports itself more stable on a floor or pallet; using the following steps of providing a continuous length of fabric sewn along a common edge to define a continuous wall portion of the bag; sewing a top to the upper edge of the continuous side wall portion of the bag; providing an octagonal shaped bottom of the bag; and sewing a straight seam between the lower edge of the side wall along each of the eight sides of the octagonal shaped bottom which results in quicker time to construct the bag and reduces or eliminates the bulging of the side walls when the bag is filled with bulk product.

Therefore, it is a principal object of the present invention to provide a new design for a bulk bag having multiple sides, greater than four in number, and would have a shape other than the current square or round shape of conventional bulk bags, which results in a bag having a larger footprint for supporting itself upright when filled with product.

It is a further principal object of the present invention to provide a new design for a bulk bag having an octagonal shape which results in a bag using less fabric than round bags for the bottom, less side wall fabric than square bags, and is faster to construct than a current round bottom bag.

It is a further object of the present invention to provide a bulk bag having an octagonal shaped bottom which is not necessarily unilateral in shape, and can be adjusted to match any particular pallet size that the consumer wishes to match.

It is a further object of the present invention to provide a bulk bag having an octagonal shaped bottom which rests securely on a pallet without leaning and maintains substantially straight sides when the bag is filled with bulk material.

It is a further object of this invention to provide a new base design that will improve stability for the filled bulk bags that is also economical to produce.

Further, in summary, the present invention provides a design for a bulk bag that eliminates the natural tendency for filled bags to lean while providing an efficient manner of production. This is accomplished by creating an octagonal shape for the bottom of the bag.

In the preferred embodiment, the shape of at least the bag bottom is eight-sided, or octagonal shape. The top of the bag may also be octagonal but is not necessary for the invention. However, the term multi-sided bag may be used to describe that embodiment and any other embodiment which may include sides which number greater than four.

For purposes of discussion, the continuous sidewall portion of the octagonal bag may be constructed of a one piece of fabric, or it may have a plurality of fabric panels sewn together at their edges to define the continuous sidewall as used herein.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE PREFERRED EMBODIMENT

Prior to turning to the bulk bag of the present invention, reference is made to FIGS. 1A through 4C to discuss the prior state of the art in bulk bags in general.

Figure 1A:
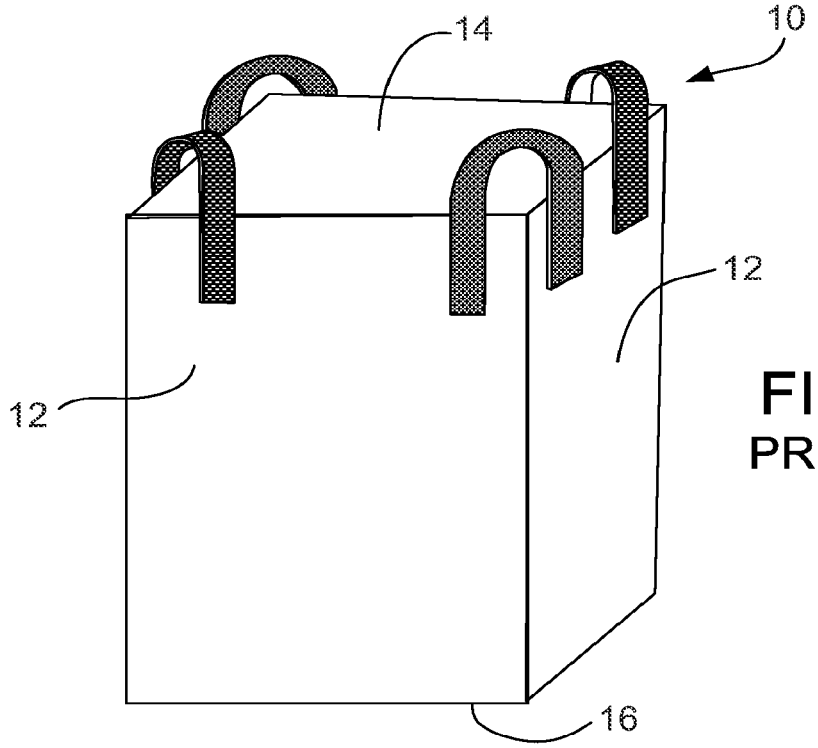
FIG. 1A PRIOR ART
FIGS. 1A through 4C illustrate the current state of the prior art in square bottom and round bottom bulk bags.

In FIG. 1A there is illustrated a bulk bag 10 of the type which is manufactured in a basic square shape, having four side walls 12, a top 14, and a floor portion 16. This example illustrates the shape of the bag before it is filled with product.

Figure 1B:
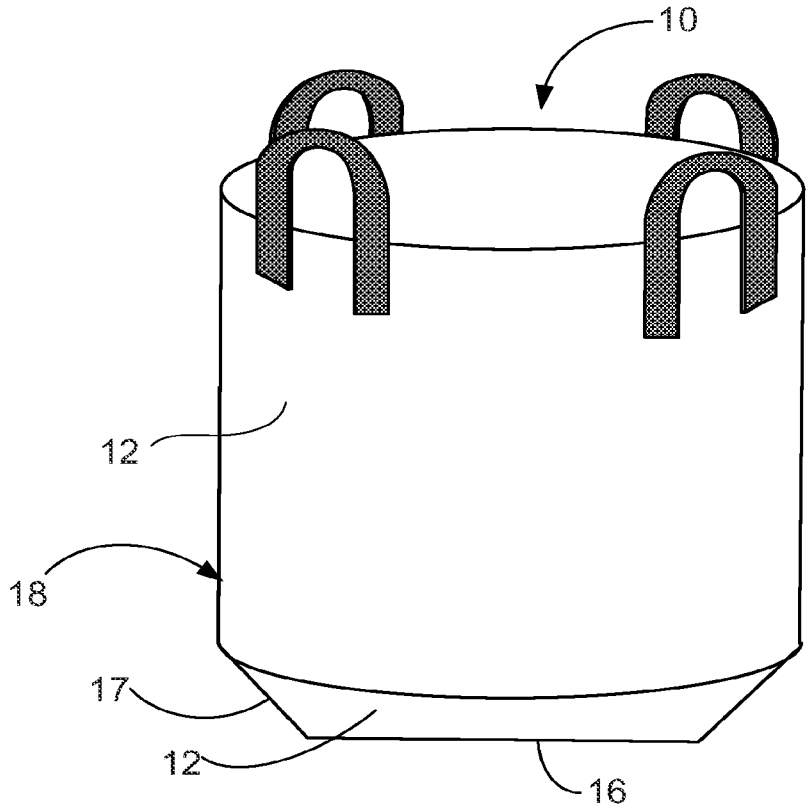
FIG. 1B PRIOR ART

However, as illustrated in FIG. 1B, the bulk bag 10 is filled with product, the bulk material naturally piles up inside the bag in a conical shape with equal forces in all directions. This equal force reshapes the bag side walls 12 above the square bottom 16 into a cylindrical shaped bag 18. This causes a transitional area 17 that starts from the bottom 16 and ends when the bag has reached full cylindrical shape 18. As seen in FIG. 1B, the floor portion 16 is much smaller than the cylindrical portion 18.

In the example given of a 37 inch (94 cm) square prior art bag, the floor portion 16 is 37 inches (94 cm) square but the cylindrical portion 18 is 47.1 inches (120 cm) in diameter. Or a little over 10 inches (25 cm) wider than the square base 16 of the bag 10. The results that occur because of this difference is illustrated in FIGS. 2A and 2B.

Figure 2A:
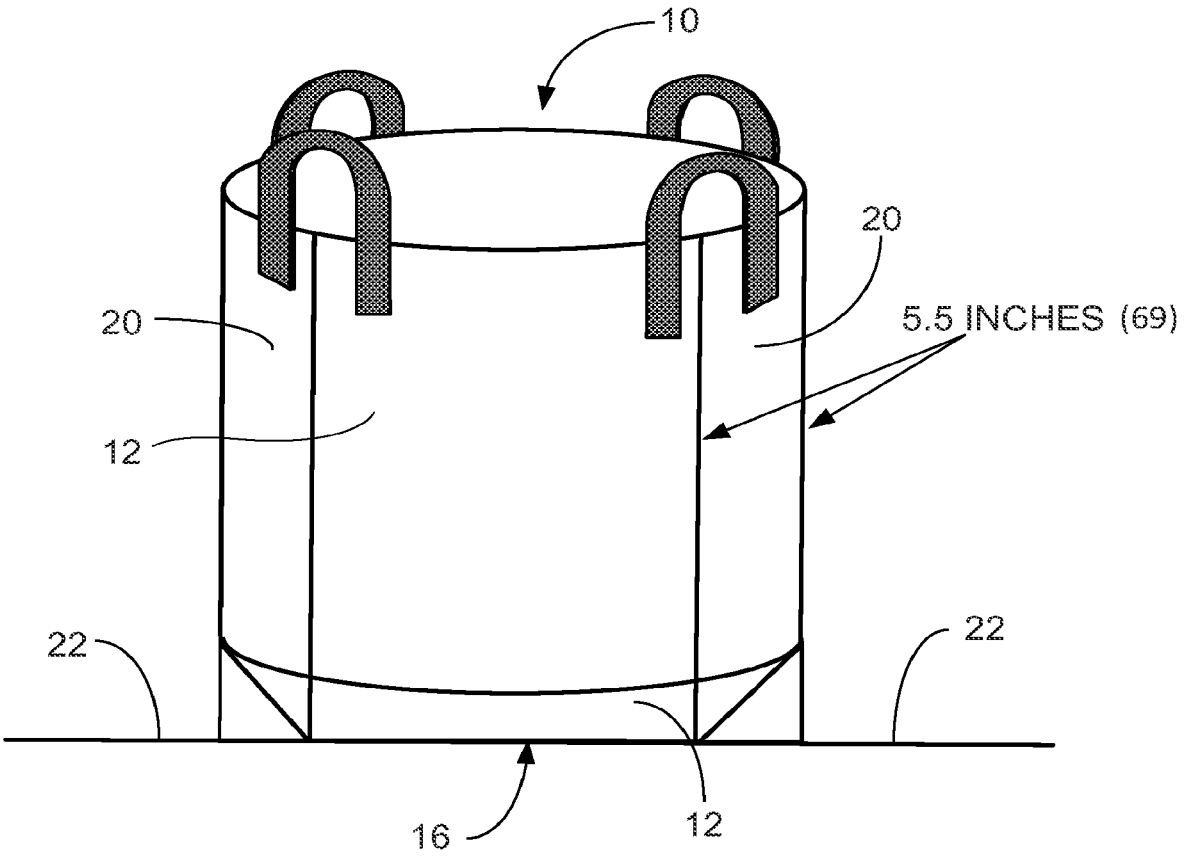
FIG. 2A PRIOR ART
Figure 2B:
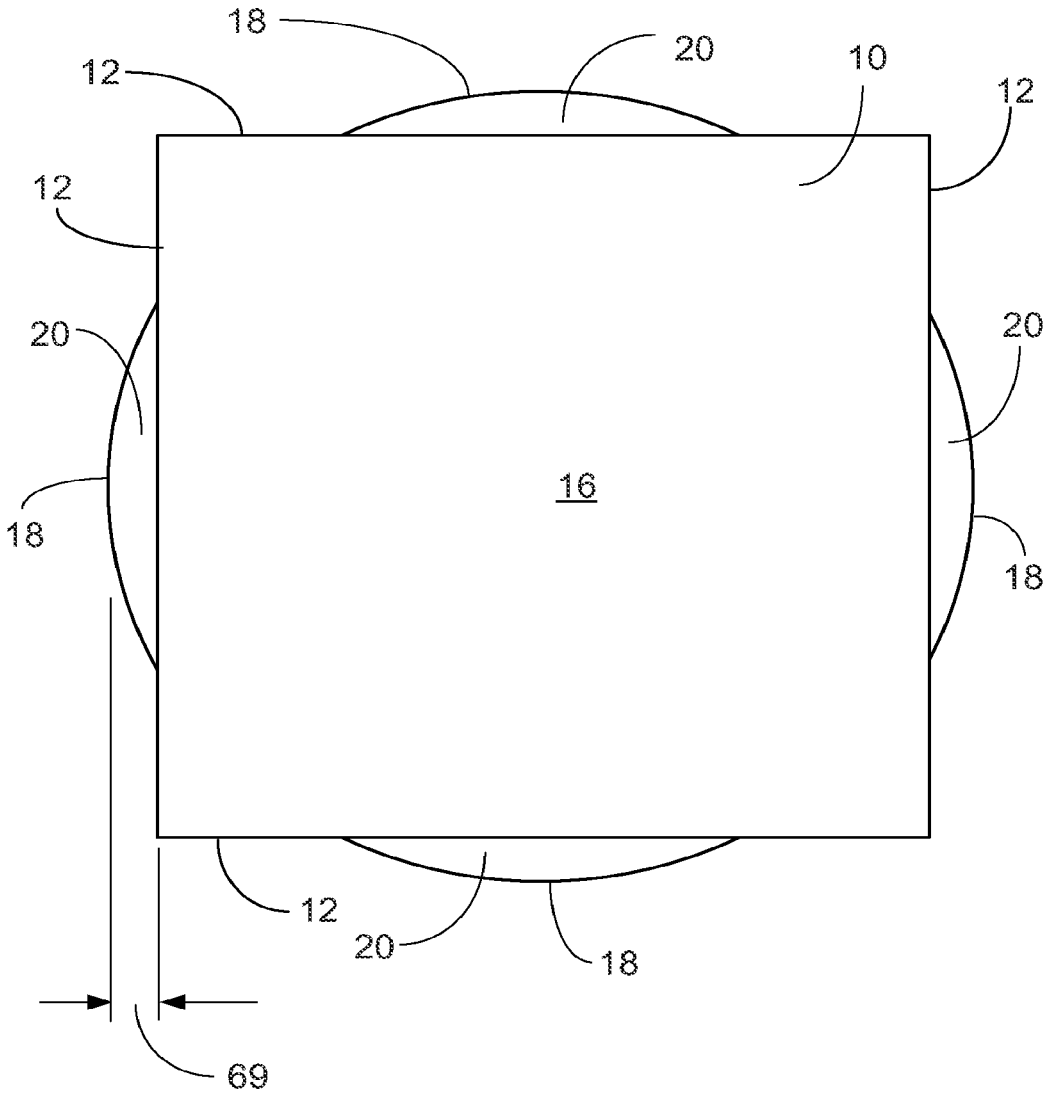
FIG. 2B PRIOR ART

As illustrated in FIGS. 2A and 2B, areas 20 along the length of the bag 10 represent the unsupported columns of product within the bag and not illustrated. These areas 20 represent approximately 25% of the product within the bag 10. As a result of this much unsupported weight in the unsupported columns 20 of product, this product, through the force of gravity, will seek a base and sag downwards until it reaches the floor 22. In this example, the portions of the cylinder 18 that is unsupported, is shown as unsupported columns 20 of product. In this example the width of the unsupported columns 20 of product is approximately 5 inches (13 cm) (Arrows 69).

Figures 3A, 3B, 3C:
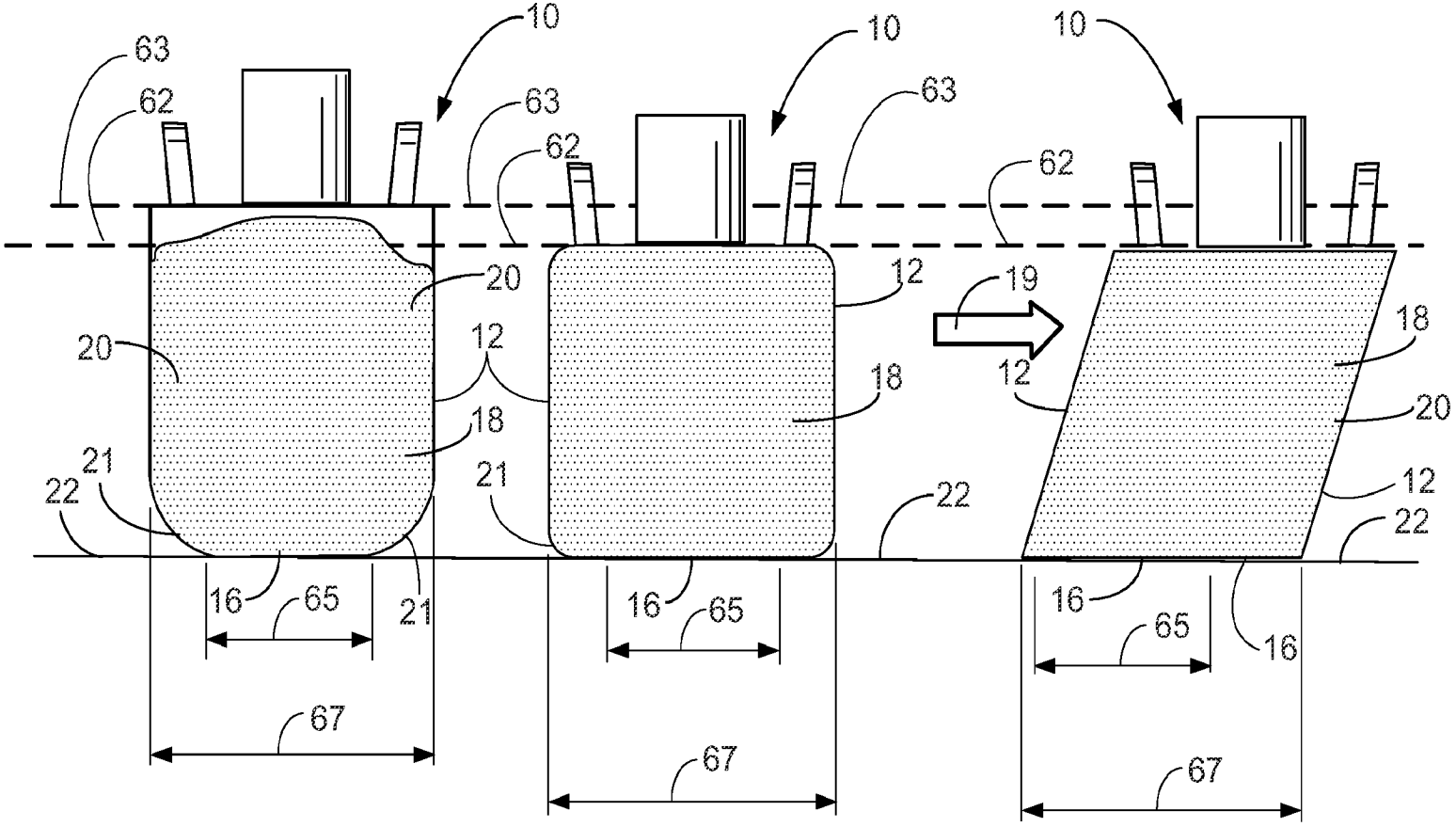
FIG. 3A PRIOR ART
FIG. 3B PRIOR ART
FIG. 3C PRIOR ART

An additional problem with the Prior Art Bags is illustrated in FIG. 3A through 3C. These three figures together illustrate the issue that unsupported columns of product create.

FIG. 3A shows the initial condition of bulk bag 10 immediately after filling. It shows the space 21 between the floor 22 and the unsupported columns 20 of product. It depicts the initial height 63 of a recently filled bulk bag.

FIG. 3B shows the condition of bulk bag 10 when it is able to settle in a perfectly vertical manner. As illustrated, the sidewall 12 is now partially vertical and partially horizontal. As a result the bag height 63 has now been reduced and is lower than original bag height. The new height is illustrated as 62. However, since, in FIG. 3B, this has happened evenly around the entire base of the bag 10, the cylindrical portion 18 of the bag 10 is still standing very vertically.

FIG. 3C shows the condition of bulk bag 10 when it has any inertial force 19 such as transportation causing the bag to settle more in one direction than another. Bag height 63 is basically the same but the bag is no longer standing vertically. Bag bottom 16 is no longer centered beneath the bag (Arrow 65) as one bag side 12 has a much bigger portion (Arrow 67) laid horizontally. Since one side is now vertically shorter, the bag and product have moved into a leaning position. In this figure, a filled bag 10 which is typical of the current art, has a 37 inch (94 cm) square bottom 16. The bag above has rounded out to a 47 inch (119 cm) cylinder 18. The cylinder 18 has leaned to the right until the unsupported columns 20 of product are resting on the floor 22 below. To do this, it has used or converted part of side wall 12 to the bottom 16. Such a bag is not only unattractive, it is less stable and less safe when being stacked upon.

Figure 4A:
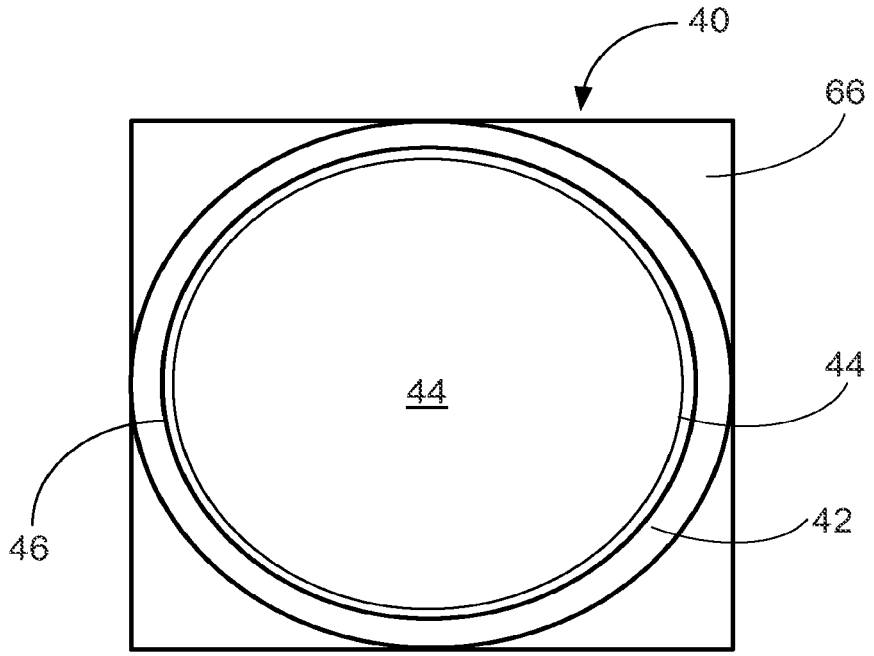
FIG. 4A PRIOR ART
Figure 4B:
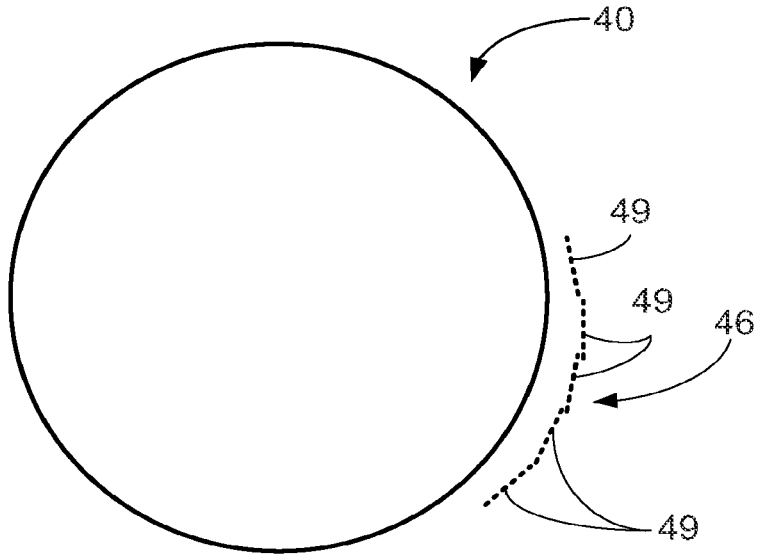

FIGS. 4A and 4B illustrate that the fully circular bottom bag 40 is somewhat uneconomical. Due to the weight that a bag must carry, the edges of the bottom panel are folded over to create the needed strength. Therefore, a panel that will fit a 47 inch (119 cm) diameter circle 44 must start out as a minimum square of fabric 66 that is 51 inches (130 cm) square. This allows for a 1.5 inch (3.8 cm) fold of fabric 42 and a 0.5 inch (1.3 cm) sew line 46 to create a 47 inch (119 cm) diameter bottom 45 that fits a 47 inch (119 cm) diameter circular wall 43.

Figure 4C:
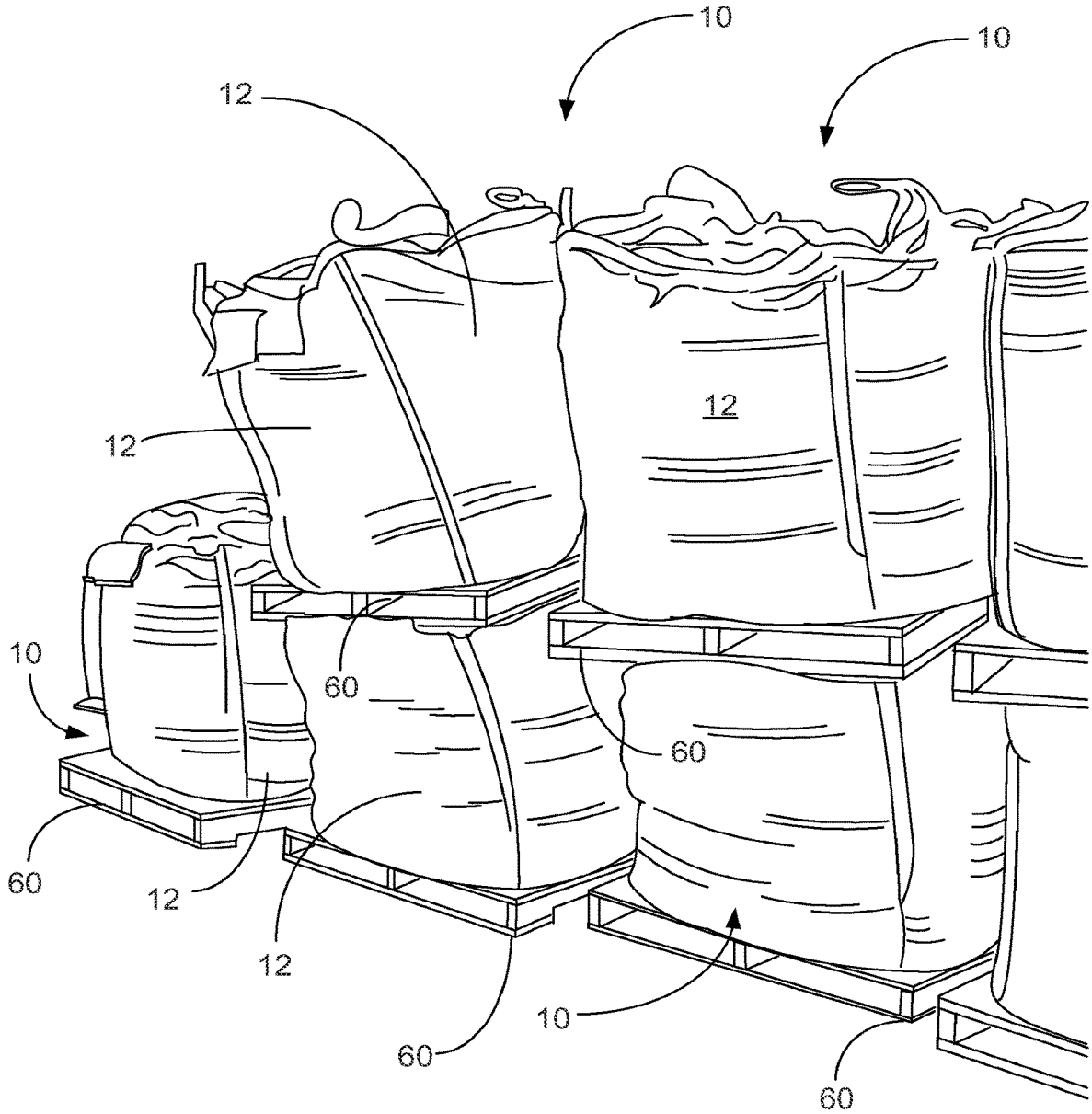
FIG. 4C PRIOR ART

In FIG. 4C a group of conventional bags 40 are illustrated, each filled with product. As seen in the figure, what has occurred to the bags shown in the figure was the result of the dynamics which occur in the prior art bags, as was previously illustrated in FIG. 3C and discussed above. These bags in FIG. 4C show the condition of bulk bag 10 being acted upon by inertial forces, causing the bag to settle more in one direction than another. Bag height is basically the same but the bag is no longer standing vertically. The bags 10 have rounded out to a cylinder 18, which has caused the bags 10 to lean and sag until unsupported columns 20 of product are resting on the floor 22 below. To do this, it has used or converted part of side wall 12 to the bottom 16. Such a bag is not only unattractive, it is less stable and less safe when being stacked upon.

Having to start with a larger square of fabric requires, in this case, nearly 300 square inches (1935 square cm) of extra fabric cost. Additionally, as shown in FIG. 4B, it is difficult and time consuming to sew a circular seam. The sewing machines that are used in this industry to apply heavy load bearing seams 46 are designed to sew and move in a straight line. Therefore, the circular seam 46 is actually accomplished by making a large number of small straight lines 49. 49 is intended to be the seam between the bottom and sidewalls of a prior art cylindrically shaped bag. However for clarity, the sew line is illustrated beyond the actual edge of the prior art bag. After each straight line, the operator must stop the machine and adjust the direction of fabric through the machine. This results in a comparatively slow production system with many stops as opposed to the square bag and the present invention.

Figure 5A:
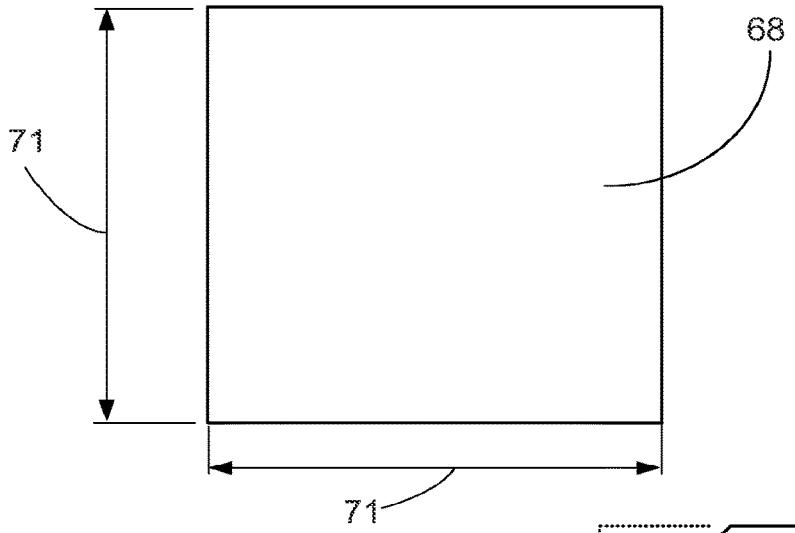
FIGS. 5A through 5C illustrate the steps involved in forming the octagonal bottom of the bag from a square sheet of fabric in a preferred embodiment of the octagonal bottom bag of the present invention.

Turning to the present invention, reference is made first to FIGS. 5A through 11. In FIG. 5A, there is illustrated a view of the bottom panel 68 that will become the bottom of the present invention. In this example, the beginning fabric is cut 48 inches (122 cm) square (Arrows 71).

Figure 5B:
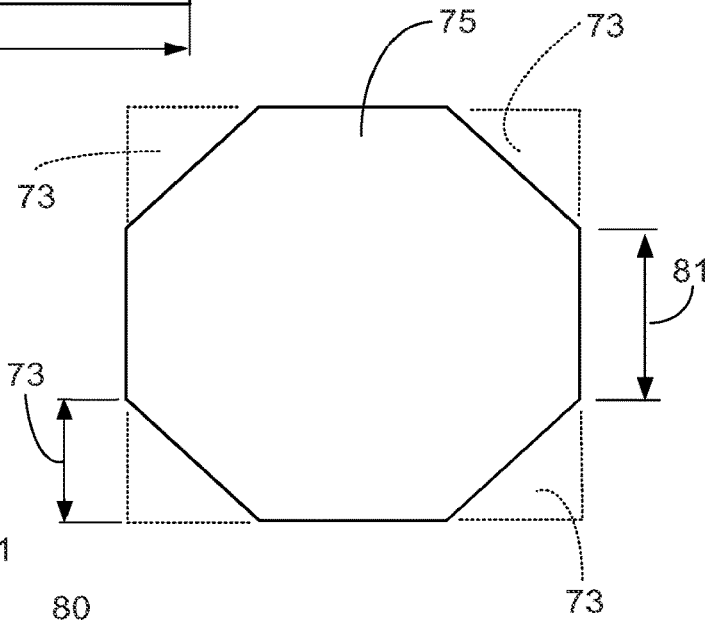

FIG. 5B shows that four triangular pieces 73, in phantom view, must be either removed by cutting or folded to make an octagonal shape bottom 75, having eight octagonal sides 81, the bottom 75 being 48 inches (122 cm) across the vertical and horizontal centerline.

Figure 5C:
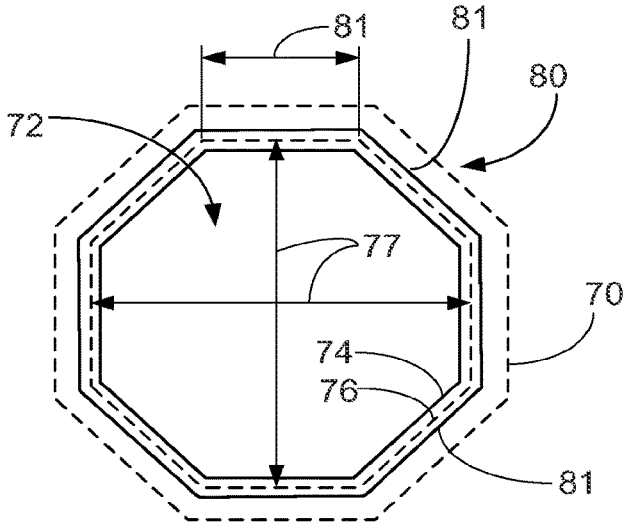

FIG. 5C illustrates the final octagonal bottom 72 for the octagonal bag 80. This final shape is created by folding the second stage of octagonal panel 70 1.25 inches (3.18 cm) on all eight sides 81. When this is sewn to the side walls 12 with a 0.5 inch (1.3 cm) scam 76, the result is the final octagonal bottom 72 that is 44.5 inches (113 cm) across the center lines in both directions. (Arrows 77)

FIGS. 5A through 5C further illustrate how to make a perfectly uniform octagonal bag for bags with a perimeter of 148 inches (376 cm). It is obvious that this shaping of the bottom can be done for any perimeter size of bulk bag and gain the benefits already spoken of. In reality, what defines the invention of the octagonal bag disclosed herein, is that the octagonal shape of the bag defines a larger footprint for a filled bulk bag, and in doing so, eliminates the problems of sagging of filled bags which results in sidewalls becoming part of the support surface of the filled bags. In the octagonal bag, the larger footprint eliminates this problem, for the reasons as will be discussed below.

Figure 6:
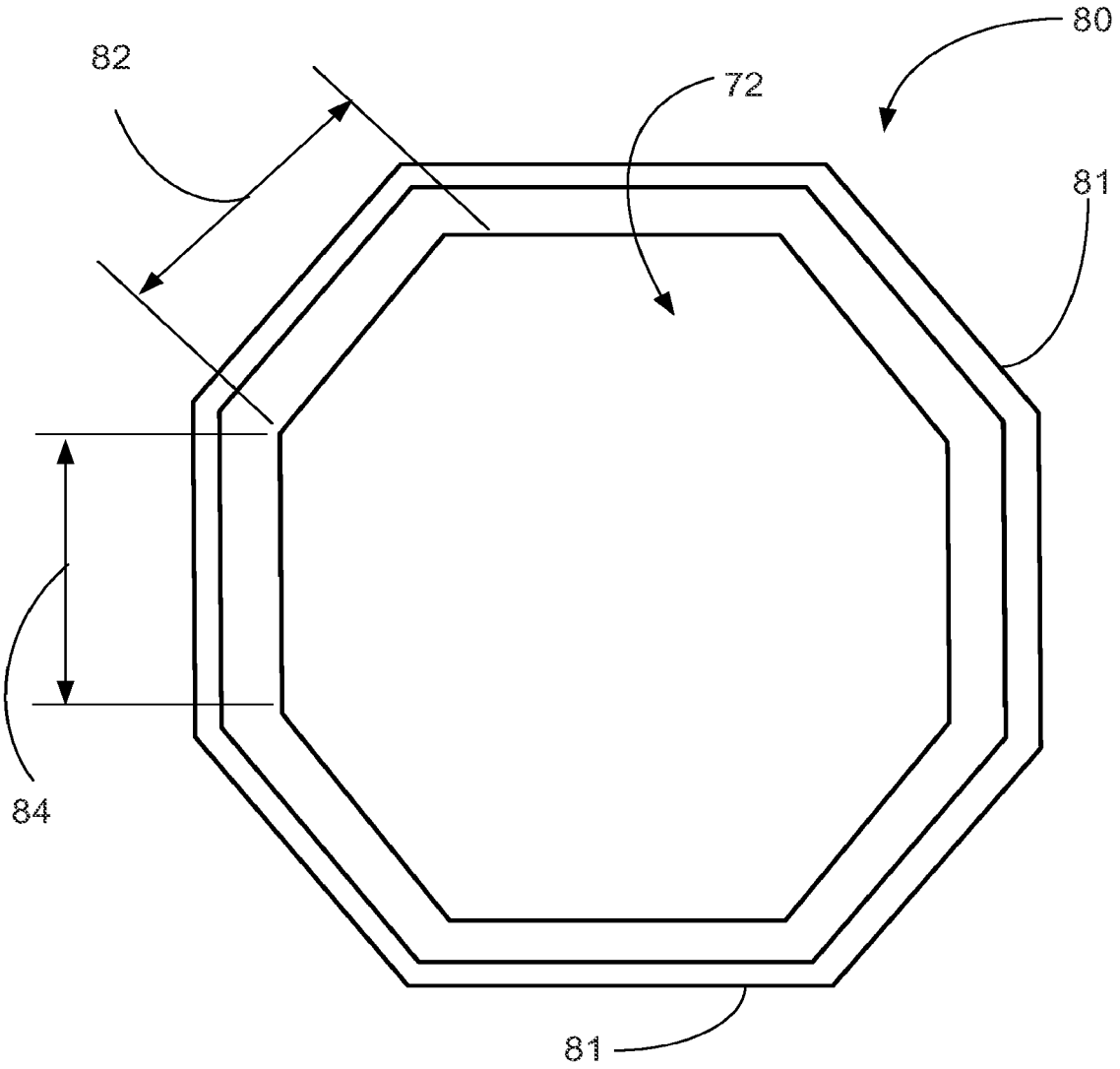
FIG. 6 illustrates a bottom view of the octagonal bottom bag, after it has been cut to the various dimensions of each of the eight sides of the bottom of a preferred embodiment of the present invention.

As illustrated by FIG. 6, a perfect octagon is not always preferred. When making a circular woven bag, it speeds production up to use the markings that already exist on the fabrics to indicate to the sewing machine operator when to make the turn for the next of the eight octagonal sides 81. In this example, those pre-existing marks are at 16 inches (41 cm) (Arrows 82) and 21 inches (53 cm) (Arrows 84) apart. Modifying the octagonal bottom 72 to take advantage of these marks does not notably deteriorate the performance of this bag therefore, it is anticipated that many manufacturers will manufacture in this manner.

Figure 7:
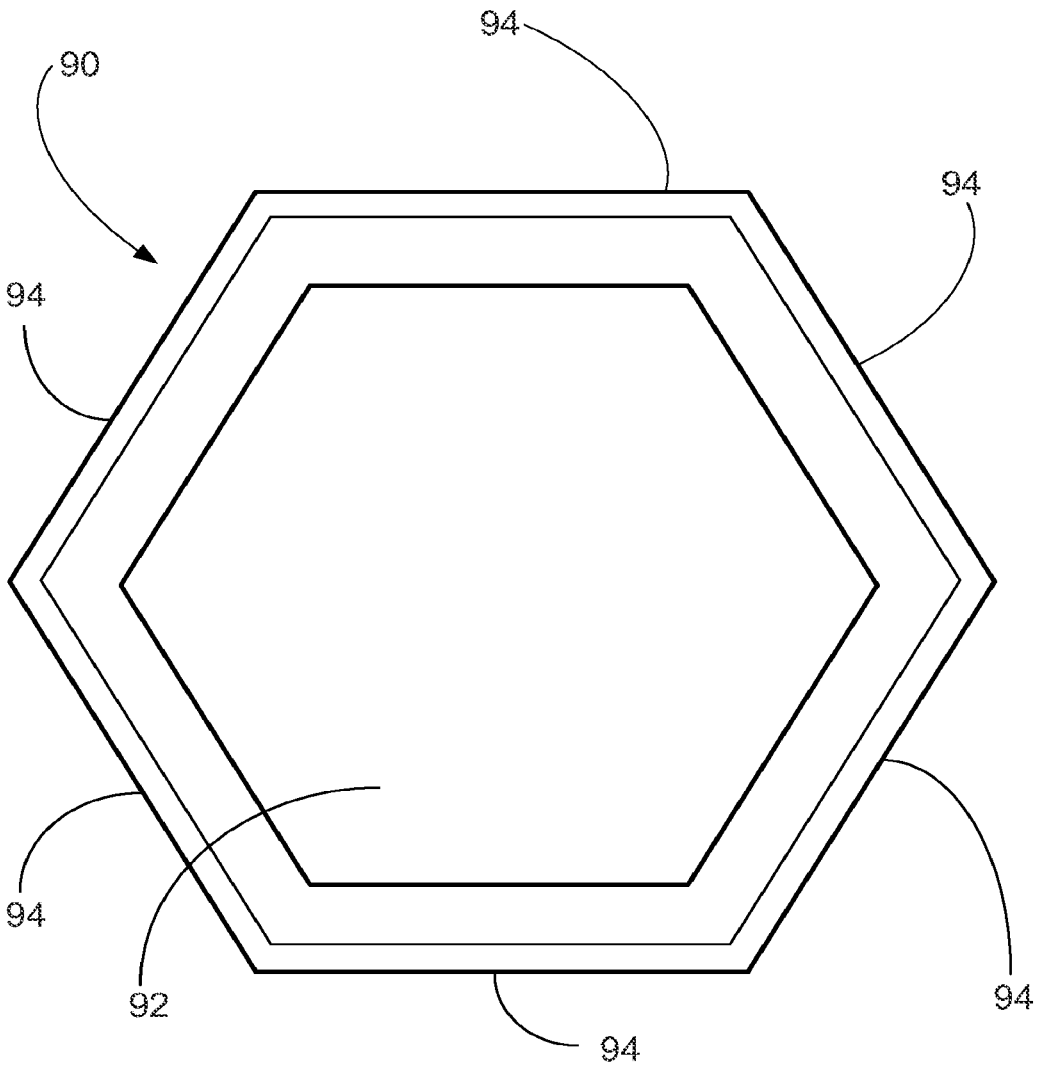
FIG. 7 illustrates an additional embodiment of the multi-sided bulk bag illustrating the bag cut having a hexagonal configuration.
Figure 8:
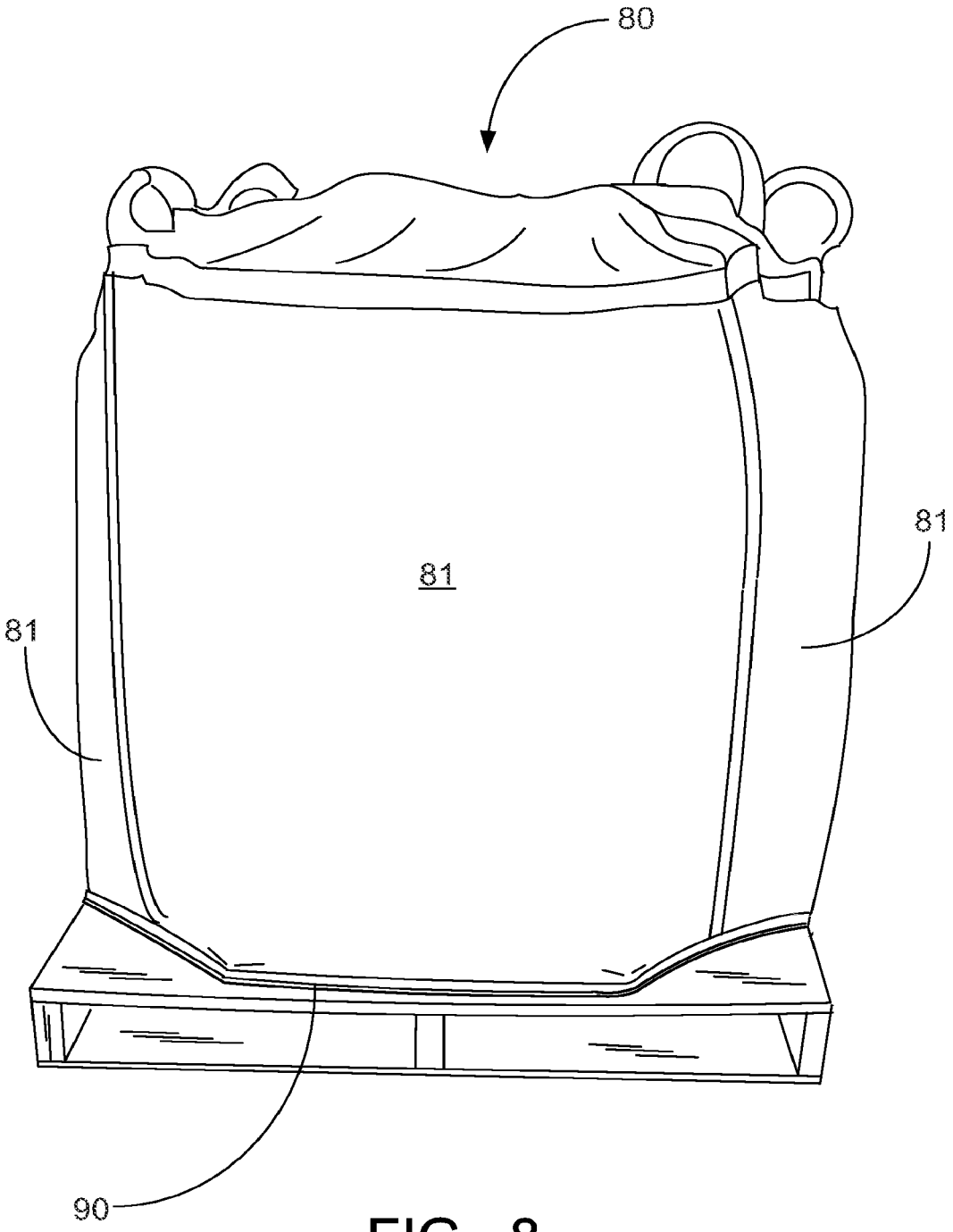
FIG. 8 illustrates an overall view of an octagonal bottom bag filled with product set upon a conventional pallet.

Although the octagonal shape is the preferred embodiment of the bag, reference is made to FIG. 7 which shows a bag bottom 90 cut in a hexagonal shape 92. The multi-sided bag, having six sides 94, would perform similarly to the octagonal shaped bag 80, and in fact it is foreseen that a bulk bag having multiple sides greater than four would, in theory, perform better than a prior art four sided bag.

Returning to the preferred embodiment of the bulk bag illustrated in FIGS. 5A through 6, using the same previously mentioned size bag of 37×37 inch (94×94 cm) square, what follows is a discussion of the mathematics used in this invention. For this size bag we recommend a finished Octagonal bottom panel 72 having centerline lengths of 44.6 inches (113 cm). These dimensions can obviously be altered to larger or smaller bags and larger or smaller centerline dimensions, but these are preferred dimensions.

In order to end up with 44.6 inch (113 cm) centerline dimensions in both directions, a 48 inch (122 cm) piece of fabric is the preferred starting material. This piece of fabric has 2304 square inches (14,864 square cm) of area. This is 15% less materials than is required by the round bottom bag and 30% more than the bottom for the square bag.

When this 44.6 inch (113 cm) Octagonal bottom 72 is sewn to the side walls 12 of a 37 inch (94 cm) square bag, it would have eight (8) 18.5 inch (47 cm) sides which add up to 148 inches (376 cm) of perimeter. This is identically equal to the perimeter of a 37 inch (94 cm) square bulk bag or a 47 inch (119 cm) diameter cylinder.

The resulting bottom will then have 1646 square inches (10,619 square cm) of area to support the 1742 square inches (11,239 square cm) of cylinder above it. This works out to 94.5% of the total area of the cylinder above, which defines the larger footprint of the bag.

In practical terms, the bag will have a slight bulge at the centerline of each side 12 of the original square based bag. This bulge is now only 1.25 inches (3.18 cm) beyond the base of the bag or 1.3% of the total product is bulging out beyond the base on each side.

The average bulk bag carries 2200 lbs (998 kg). In the original square bag, the amount of unsupported product is 25% of the 2200 lbs (998 kg) or a total weight of 550 lbs (249 kg). As experienced in the industry, this is more than enough unsupported weight to influence the reshaping of the bulk bag.

In the present invention, only 5.5% or 121 lbs (54.9 kg) of product is unsupported and that is divided up into 8 parts by the octagon instead of 4 parts for the prior art. Therefore, the imbalances in the octagonal shaped bag 80 have an average of only 15.1 lbs (6.85 kg) in any direction. This represents a less than 1% influence on the stability of the present invention.

As to the cost of this bag, since the prior art uses 5 inches (13 cm) of sidewall to allow the bag to get to full support position, then the present invention can be made 5 inches (13 cm) shorter and hold the same amount of product. In the example explained above, there is a saving 5 inches (13 cm) of fabric on each of 4 sides of the original square bag for a total savings of 740 Square inches (4774 square cm) of side wall fabric.

As was discussed earlier, the octagonal bottom 72 required a piece of fabric with an area of 2304 square inches (14,864 square cm) as opposed to the square bag bottom which required only 1764. However, since the octagonal bottom 72 allows the drop in side wall height of 5 inches (13 cm), we can see that the present invention uses an almost identical amount of fabric. The present invention uses 2304 sq. inches (14,864 sq. cm) for the bottom but saves 740 square inches (4774 sq. cm) on the side walls. This presents a net usage of 1564 square inches (10,090 sq. cm) for the present invention versus 1764 square inches (11,380 sq. cm) for the prior art.

On the labor side, the sewing machine operator is still sewing the same 148 inches (376 cm) of perimeter bottom but is making 8 stops and turns instead of 4 stops and turns. The effect of this is minimal and probably equal in value to the 200 square inches (1290 square cm) of fabric that the octagonal bag saves over the prior art.

As can now be seen, the octagonal bag 80 has a cost roughly equal to the prior art but has a greatly improved stability.

The shape of the octagonal bottom 72 can be altered to accomplish different objectives without substantially affecting the stability. In one design, as seen in FIG. 6, the sides of octagonal corners are altered to 16 inch (41 cm) corners and 21 inch (53 cm) sides. This alteration matches the marker yarns on circular reinforced fabrics and provides an easy visual aid for the sewing machine operators to know when to make the eight turns on the bottom to create the Octagonal shaped bottom. This speeds up the process and eliminates the need for marking the fabrics to identify the turning points. The inventor has used this method and found no identifiable deterioration in bag performance.

Figure 9:
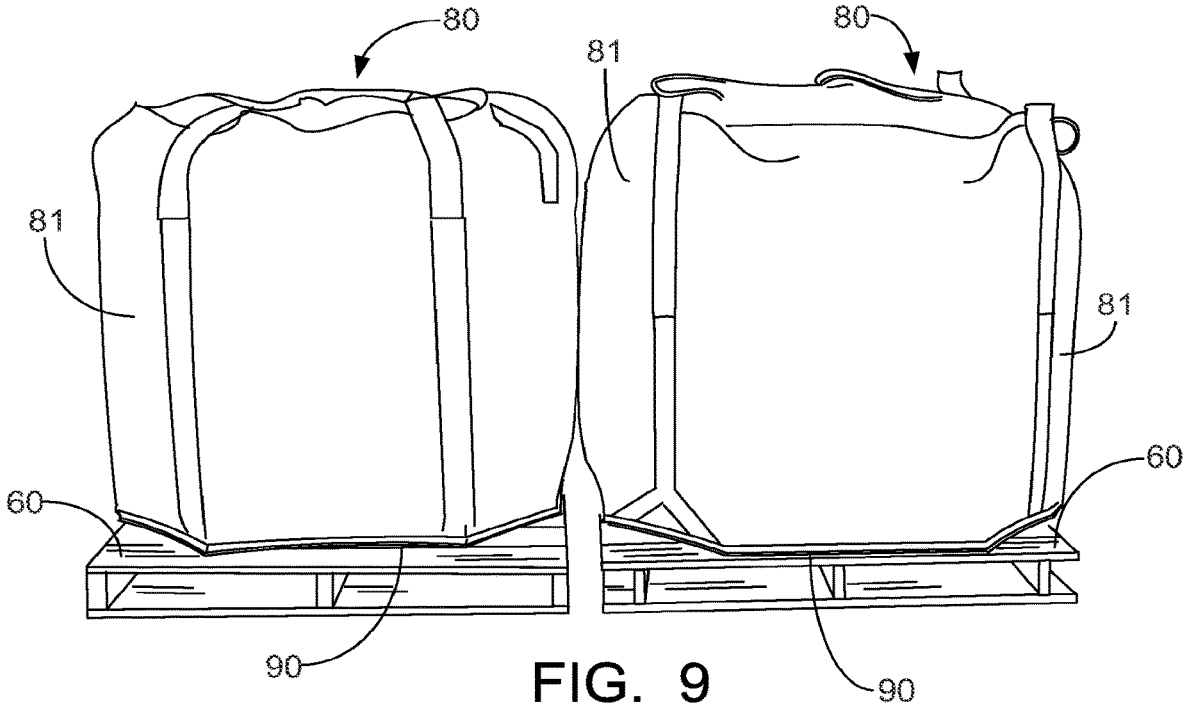
FIG. 9 illustrates two octagonal bottom bags filled with product set upon a pallet.
Figure 10:
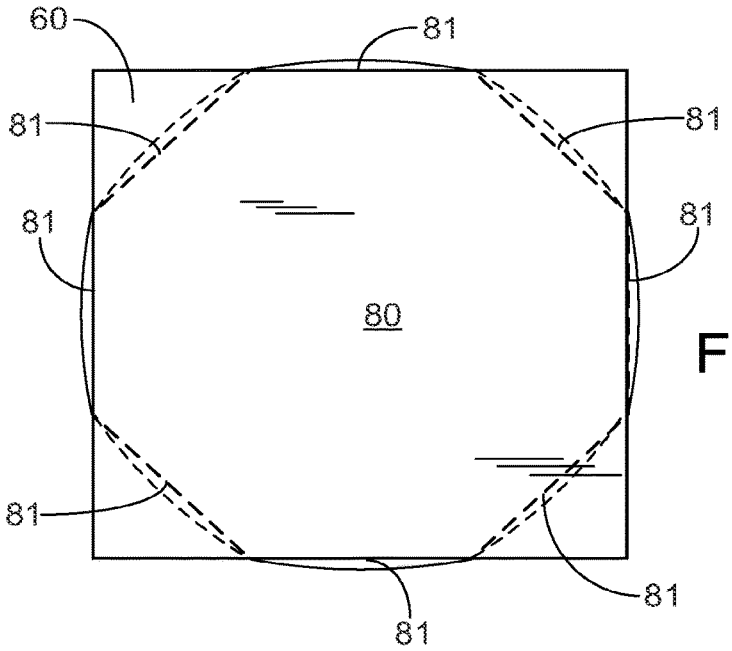
FIG. 10 illustrates an underside view of a filled octagonal bottom bag filled with product set upon a conventional pallet.
Figure 11:
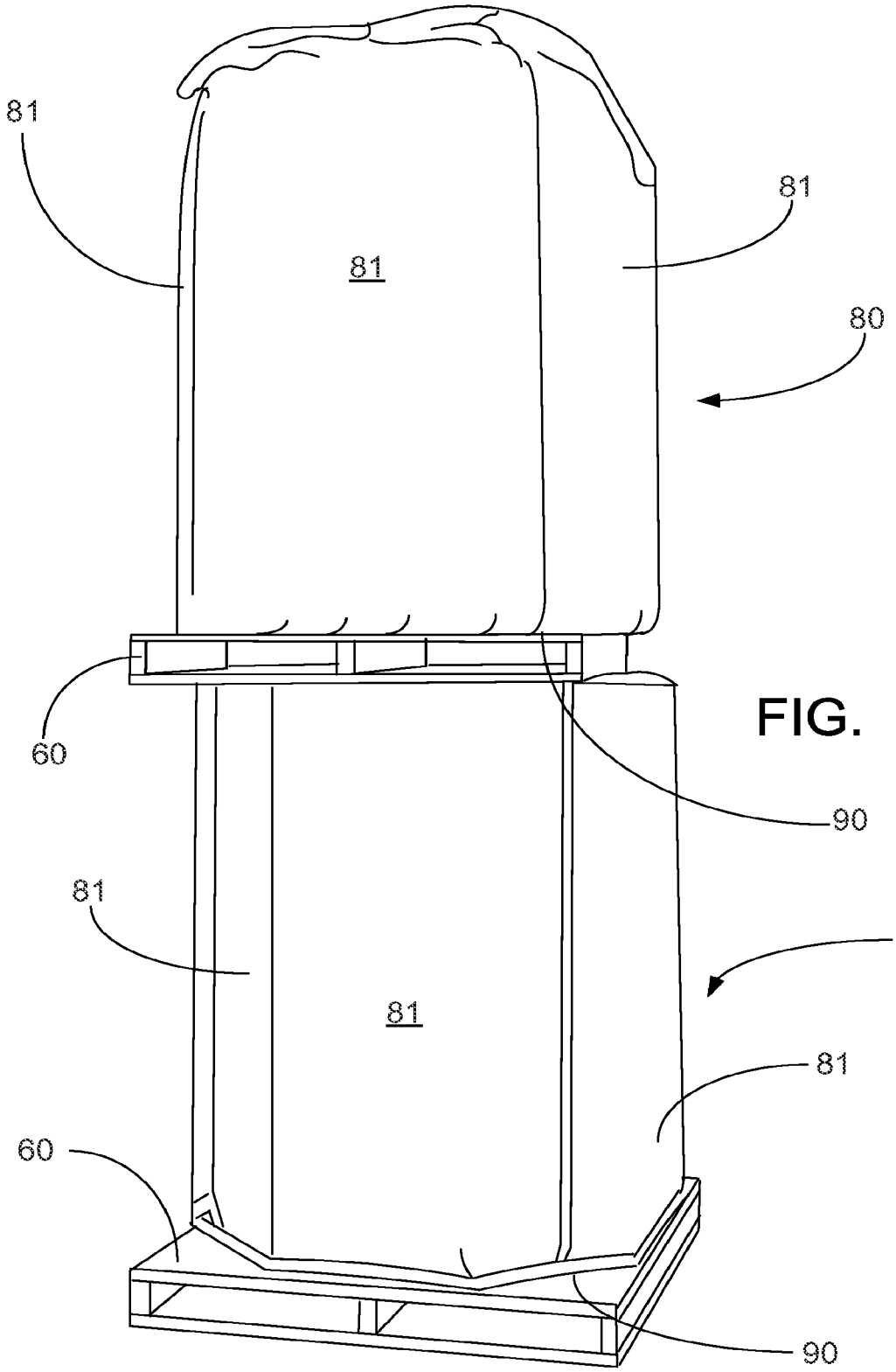
FIG. 11 illustrates an overall view of one octagonal bottom bag filled with product being supported atop a second octagonal bottom bag filled with product.

FIGS. 8 through 11 illustrate the octagonal bags 80 filled with product resting on a conventional pallet 60. As illustrated first in FIG. 8, the single bag 80, set upon a pallet 60, provides an upright filled bag, wherein because of the large footprint of the bottom 90, the sidewalls 81 have not bulged outward, as with the prior art bag shown in FIG. 2B. This due to the fact that the larger footprint of the bag 80 provides a broad, stable base upon which the filled bag 80 is supported, and in that manner, the sidewalls 81 are not inclined to sag and become part of the area upon which the product within the bag 80 rests, as in prior art bags, as seen in FIG. 2A. As seen in FIG. 9, a pair of filled bags 80 are positioned side by side, with the sidewalls 81 of both bags supported in a vertical position, on the pallet 60, and which therefore, continue to define a flat, horizontal top able to receive and support filled bags 80 in an upright position as seen in FIG. 11.

FIG. 10 illustrates an underside view of a filled octagonal shaped bag 80, resting on a pallet 60. From a comparison of this view with the prior art view as seen in FIG. 2B, it is clear that the sidewalls 81 of the bag 80 in FIG. 11, although bulging out very slight, are still well confined within the footprint of the base or bottom 90 of the bag. Therefore the sidewalls 81 are unlikely to force the bag to sag, unlike the bag in FIG. 2B, where the sidewalls 12 have bulged out a great deal which results in sagging of bags, as seen in the bags illustrated in FIG. 4C.

Now one can see that the wider base improves stability through providing a greater support surface, or a greater footprint, as it could be defined. We can also see that in the stacking of these bags, a similar top would also be beneficial as it will provide a greater surface for the upper bag to rest securely upon as well. However, it is not necessary to apply this design to the top to get the benefits of a bag that will stand stably by itself.

It is also noted that providing a larger base, or footprint, through the use of the octagonal shaped bottom is beneficial for stacking. Therefore, using this technology to provide a larger panel on the top of the bag will provide a wider stacking surface for any bags being stacked on bags with octagonally shaped tops. This will further improve the stacking safety and stability of such bulk bags.

The following is a list of parts and materials suitable for use in the present invention:

PARTS LIST

| Parts Number | Description |
|---|---|
| 10 | prior art bulk bag |
| 12 | side walls |
| 14 | top |
| 16 | floor portion |
| 17 | transitional area |
| 18 | cylinder shaped shape of bag |

-continued

PARTS LIST

| Parts Number | Description |
|---|---|
| 19 | Inertial force |
| 20 | areas of unsupported columns of product |
| 21 | distance between floor and Product |
| 22 | floor |
| 40 | prior art bag |
| 42 | folded fabric |
| 43 | circular wall |
| 44 | full circle |
| 46 | sew line |
| 50 | bulk bag |
| 52 | floor portion |
| 54 | sides |
| 55 | wall portion |
| 56 | octagonal shape |
| 58 | triangles |
| 59 | corners |
| 60 | pallet |
| 62 | initial height of bulk bag |
| 63 | final height of bulk bag |
| 64 | transportation force |
| 65 | Arrows |
| 67 | Arrows |
| 66 | 51 inch (132 cm) Fabric square |
| 68 | beginning octagon bottom panel |
| 70 | second stage of octagon panel |
| 71 | Arrows |
| 72 | final octagon bottom panel |
| 73 | triangular portions |
| 74 | 1.25 inch (3.18 cm) fabric fold |
| 75 | octagonal shape |
| 76 | seam 0.5 inches (1.3 cm) deep |
| 77 | Arrows |
| 80 | octagonal bag |
| 81 | sides |
| 82 | Arrows |
| 84 | Arrows |
| 90 | hexagonal bag bottom |
| 92 | hexagonal shape |
| 94 | sides |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A fabric bulk bag, comprising:

a) an unsupported continuous single layer sidewall, a top portion, and a bottom, all defining a bulk storage place therein;

b) the sidewall having a circular perimeter at a height between the bottom and the top portion;

c) the bottom having at least four sides and a shape that is neither a circle nor a square; and d) wherein the sidewall is operable to have one or more bulge portions at or around the height of the circular perimeter, the one or more bulge portions extending beyond the bottom and not touching a support surface upon which the bag rests.

2. The bulk bag in claim 1, wherein the continuous sidewall further comprises a plurality of fabric panels which when sewn together define the continuous sidewall.

3. The bulk bag in claim 1, wherein the bottom is not limited to a unilateral shape.

4. The bulk bag in claim 1, wherein the bag when filled has a substantially straight support structure operable to support another filled bag stacked on the bag.

5. The bulk bag in claim 1, wherein the top portion comprises the same shape as the bottom.

6. The bulk bag in claim 1, wherein the bottom has more than four (4) sides but less than seventeen (17) sides.

7. A fabric bulk bag, comprising:

a) an unsupported continuous single layer sidewall, a top portion, and a bottom, all defining a bulk storage place therein, the bag having a filled configuration and an unfilled configuration;

b) the sidewall having a circular perimeter at a height between the bottom and the top portion;

c) the bottom having at least four (4) sides and a shape that is neither a square nor a circle;

d) wherein in the filled configuration the sidewall is operable to have one or more bulge portions at or around the height of the circular perimeter, each of said one or more bulge portions extending beyond the bottom without causing leaning or sagging of the bag in the filled configuration; and e) the bag in the filled configuration having a substantially straight support structure operable to support another filled bag stacked on the bag.

8. The fabric bulk bag in claim 7 wherein the bottom has more than four (4) and less than seventeen (17) sides.

9. The fabric bulk bag in claim 7 wherein in the filled configuration, the bag on a square pallet is fully supported by the square pallet.

10. The fabric bulk bag in claim 7 wherein the circular perimeter of the bag in the filled configuration fits on a square pallet.

11. The fabric bulk bag in claim 7 wherein the shape of the bottom may be adjusted to fit a desired pallet size.

12. The fabric bulk bag in claim 8 wherein the shape of the bottom of the bag is not unilateral.

13. The fabric bulk bag in claim 8 wherein the one or more bulge portions include individual columns of unsupported product that are less than 6% of total product in the bag in the filled configuration.

14. A fabric bulk bag, comprising:

a) an unrestrained, continuous single layer sidewall, a top portion, and a bottom, all defining a bulk storage place therein for filling with material;

b) the bag having a filled configuration, wherein in the filled configuration the bag is filled with material and the sidewall of the bag has a rounded shape and a perimeter at a location between the top and the bottom;

c) the bottom having at least four sides and a shape that is neither a square nor a circle;

d) the sidewall having one or more bulge portions in the filled configuration that extend a distance beyond the bottom; and e) wherein the shape of the bottom is adapted to prevent the one or more bulge portions of the sidewall from making contact with a support surface that the bag is resting on in the filled configuration.

15. The bag of claim 14 wherein the bottom is coupled to the sidewall at an attachment seam and the bottom has at least 12% more square inches inside the attachment seam than would a square shaped bottomed bag that has an equal bag perimeter.

16. The bag of claim 14 wherein the shape of the bottom creates at least 12% more contact with a surface that the bag is resting on than would a square bottom of a square shaped bottom bag that has an equal bag perimeter.

17. The fabric bulk bag in claim 14 wherein the shape of the bottom may be adjusted to fit a desired pallet size.

18. The fabric bulk bag in claim 14 wherein the shape of the bottom of the bag is not unilateral.

19. The bulk bag in claim 14, wherein the top portion has the same shape as the bottom.

* * * * *